US006565409B1

(12) United States Patent
Isogai

(10) Patent No.: US 6,565,409 B1
(45) Date of Patent: May 20, 2003

(54) STOP MECHANISM OF MODEL CAR

(75) Inventor: Yasuo Isogai, Nogi-machi (JP)

(73) Assignee: CCP Co., Ltd., Saitama (JP)

( * ) Notice: Subject to any disclaimer, the term of this patent is extended or adjusted under 35 U.S.C. 154(b) by 0 days.

(21) Appl. No.: 10/218,001

(22) Filed: Aug. 13, 2002

(30) Foreign Application Priority Data

Jan. 24, 2002 (JP) ..... 2002-015314

(51) Int. Cl.[7] ..... A63H 17/00; A63H 29/24
(52) U.S. Cl. ..... 446/437; 446/454; 446/448
(58) Field of Search ..... 446/396, 431, 446/437, 443, 454, 456, 457, 445, 448

(56) References Cited

U.S. PATENT DOCUMENTS 4,449,323 A * 5/1984 Fisher ..... 446/437
4,850,931 A * 7/1989 Auer ..... 446/437
5,019,009 A * 5/1991 Chao-Chin et al. ..... 446/437
6,241,574 B1 * 6/2001 Helbing ..... 446/454

* cited by examiner

*Primary Examiner*—Jacob K. Ackun
(74) *Attorney, Agent, or Firm*—Jordan and Hamburg LLP

(57) ABSTRACT

This invention provides a stop mechanism capable of stopping a model car under a spin-turn state. A seesaw-shaped swing member 22 is mounted to a car body 11 of a model car 10 at a position deviated either to the right or left from a centerline of the car body 11 in a driving direction. An axle 21 of driving rear wheels 13 supports the swing member 22 and allows it to swing. A driving motor 20 is fitted to rear side of the swing member and a stopper plate 23, to the front side. A spring 25 for always biasing the swing member in a direction in which the stopper plate of the swing member comes into touch with a road surface 30 is interposed between the swing member and the car body. An intermeshing gear is arranged in such a fashion that a direction of reaction force transmitted from the driving rear wheels to the driving motor operates in a direction in which the stopper plate is separated from the road surface against the biasing force of the spring when the driving motor is rotated for advance.

2 Claims, 3 Drawing Sheets

STOP MECHANISM OF MODEL CAR

BACKGROUND OF THE INVENTION

1. Field of the Invention

This invention generally relates to a stop mechanism of a model car. More particularly, the invention relates to a stop mechanism for use in a model car of a type in which driving force of a driving motor mounted to a car body is transmitted to driving rear wheels through an intermeshing gear to drive the model car, and the car body comes to a stop while undergoing spin-turn when rotation of the driving motor is stopped.

2. Description of the Related Art

Model cars operated through a remote control operation generally receive an operation signal transmitted from a transmitter by a receiver mounted to a car body and transmit the operation signal to a driving motor.

Therefore, the driving motor starts or stops rotating in accordance with instruction of the operation signal, and an operation state of the driving motor such as rotation and stopping is as such transmitted to driving wheels (mainly, rear wheels).

To improve a realistic feeling similar to that of actual cars, some of the model cars stop while a car body is under a spin-turn state (a transverse state relative to a driving direction) as is known in the art. In the model cars of this type, a stop rod is caused to protrude to a running road surface from the bottom surface of either the right or left side of the car body (from the left side in this explanation) simultaneously with the stop of rotation of the driving wheels. In this instance, the distal end of the stop rod is brought into touch with the road surface to generate frictional resistance on one of the sides of the car body. The model car stops while the car body turns to the left (that is, under the spin-turn state) owing to this frictional resistance.

To stop the car body under the spin-turn state, however, it is necessary to simultaneously push a stop button of a transmitter and a projection button of the stop rod. This operation of simultaneously pushing the two buttons is rather troublesome for an unskilled operator.

Further, to cause the stop rod to protrude from the bottom surf ace of the car body, a cam mechanism is necessary for moving the stop rod in a vertical direction. Nonetheless, when this cam mechanism is afresh assembled into the model car, the number of components increases and an overall construction gets more complicated.

SUMMARY OF THE INVENTION

It is an object of the invention to provide a model car that has an easy-to-operate transmitter for even an amateur, can reliably exhibit a spin-turn operation at the time of stop through a simple construction and can solve all the problems described above.

The invention of claim 1 for accomplishing the object described above provides a stop mechanism for use in a model car of a type in which driving force of a driving motor is transmitted to driving rear wheels through an intermeshing gear for running the model car, comprising a seesaw-shaped swing member mounted at a position of a car body deviated either to the right or left from a center line of the model car in a driving direction, and supported by an axle of the driving rear wheels in such a fashion as to be capable of swinging; a driving motor fitted to a rear side of the swing member; a stopper plate fitted to a front side of the swing member; a spring for always biasing the swing member in a direction in which the stopper plate of the swing member comes into touch with a road surface, interposed between the swing member and the car body; and an intermeshing gear arranged in such a fashion that when the driving motor is rotated for advance, reaction force transmitted from the driving rear wheels to the driving motor operates in a direction in which the stopper plate is separated from the road surface against the biasing force of the spring.

When the driving motor is rotated for advance according to the stop mechanism of the model car of the invention, its driving force is transmitted to the driving rear wheels through the intermeshing gear and the model car runs linearly straight.

In other words, when the driving motor is rotated for advance, the reaction force transmitted from the driving rear wheels to the driving motor operates in a direction in which the stopper plate is separated from the road surface against the biasing force of the spring. Since the swing member automatically inclines towards the rear side at this time, the stopper plate comes out of touch from the road surface and the right and left wheels of the driving rear wheels uniformly rotate and advance on the road surface.

When the driving motor stops rotating and advancing, inertia force acts on the model car. Therefore, the model car gradually decreases its speed and comes to halt. Since the reaction force from the driving rear wheels extinguishes at the same time, the reaction force resisting the biasing force of the spring no longer exists. Consequently, the swing member automatically inclines towards the front side and the stopper plate comes into touch with the road surface.

One of the right and left sides of the car body suddenly stops owing to the frictional resistance occurring at the distal end of the stopper plate. Because the driving rear wheels keeping touch with the road surface rotate due to inertia while decreasing the speed on the other side of the car body, the car body comes to halt under the spin-turn state to either the right side or the left side.

In the stop mechanism of a model car according to claim 1, the invention of claim 2 provides a stop mechanism wherein the intermeshing gear is arranged in such a fashion that a direction of reaction force transmitted from the driving rear wheels to the driving motor operates in the same direction as a direction in which the stopper plate is brought into touch with the road surface when the driving motor is rotated for backward movement.

In this case, the reaction force occurring when the backward turning force of the driving motor is transmitted to the driving rear wheels pushes the stopper plate to the road surface and the driving rear wheel in the proximity of the stopper plate is caused to float from the road surface. Consequently, when the driving motor is rotated for backward movement, continuous pivot rotation becomes possible with the stopper plate as the turning center. When the backward rotation is stopped, the model car as such comes to halt (the model car does not enter the spin-turn state because it is no longer running straight).

DESCRIPTION OF THE PREFERRED EMBODIMENTS

A stop mechanism of a model car according to a preferred embodiment of the invention will be hereinafter explained in detail with reference to the accompanying drawings.

Figure 1:
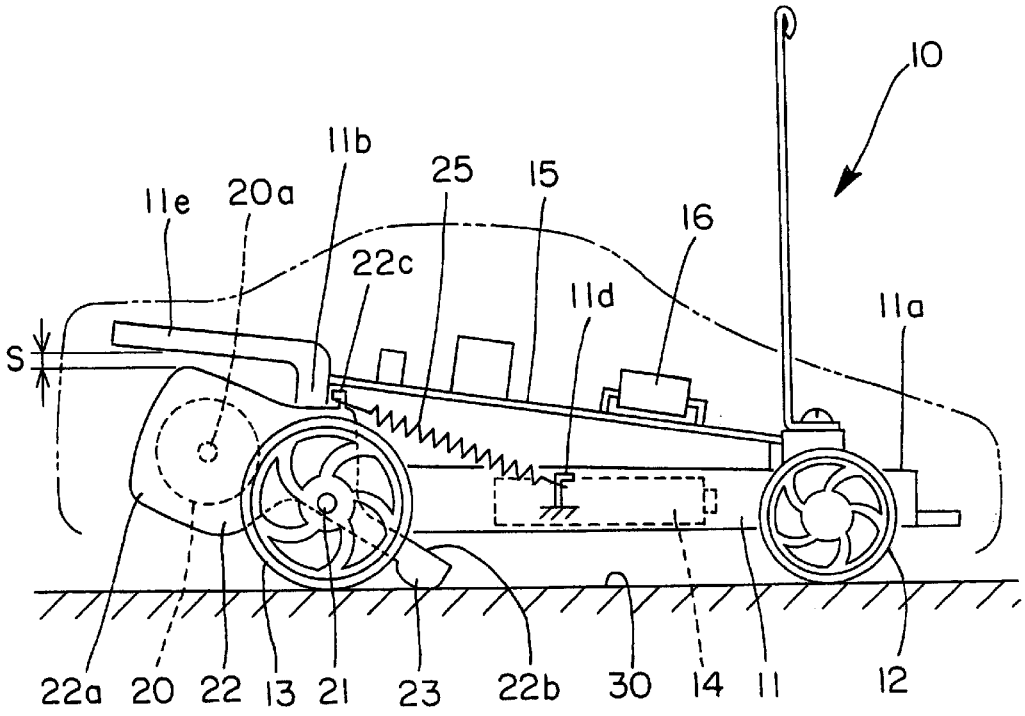
FIG. 1 is a side view showing a stop mechanism of a model car according to the invention.
Figure 1:
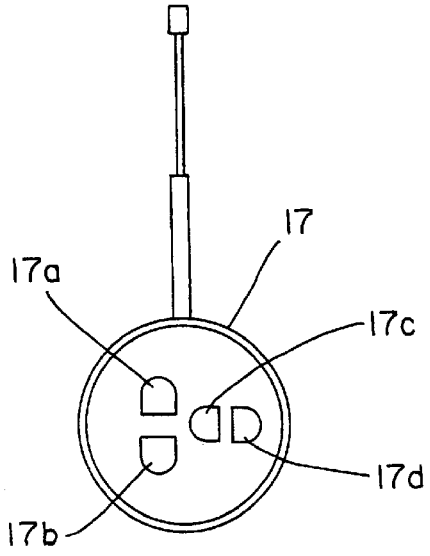
Figure 2:
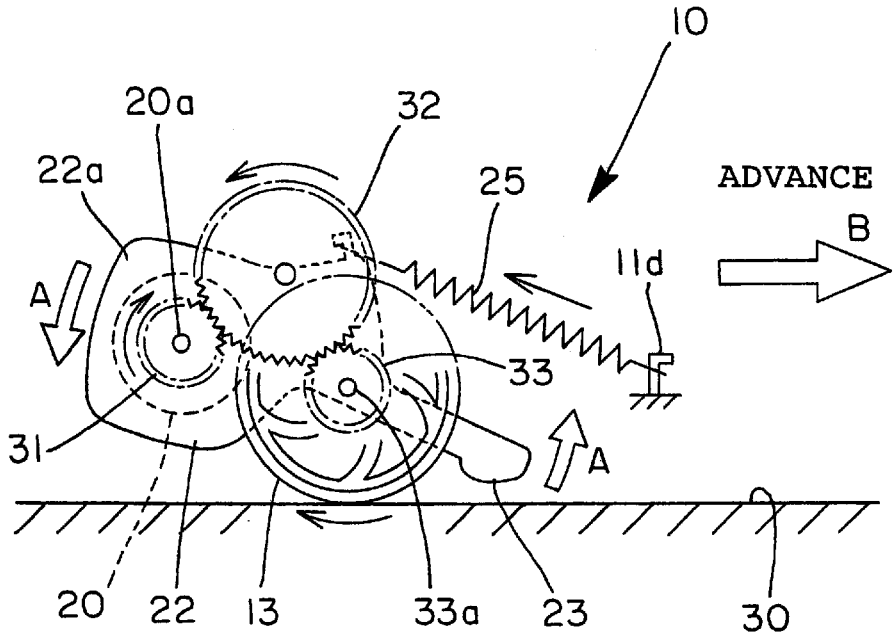
FIG. 2 is a mechanical view showing principal portions of the model car of the invention and useful for explaining the state where the model car shifts from an advancing state to a spin-turn state.
Figure 3:
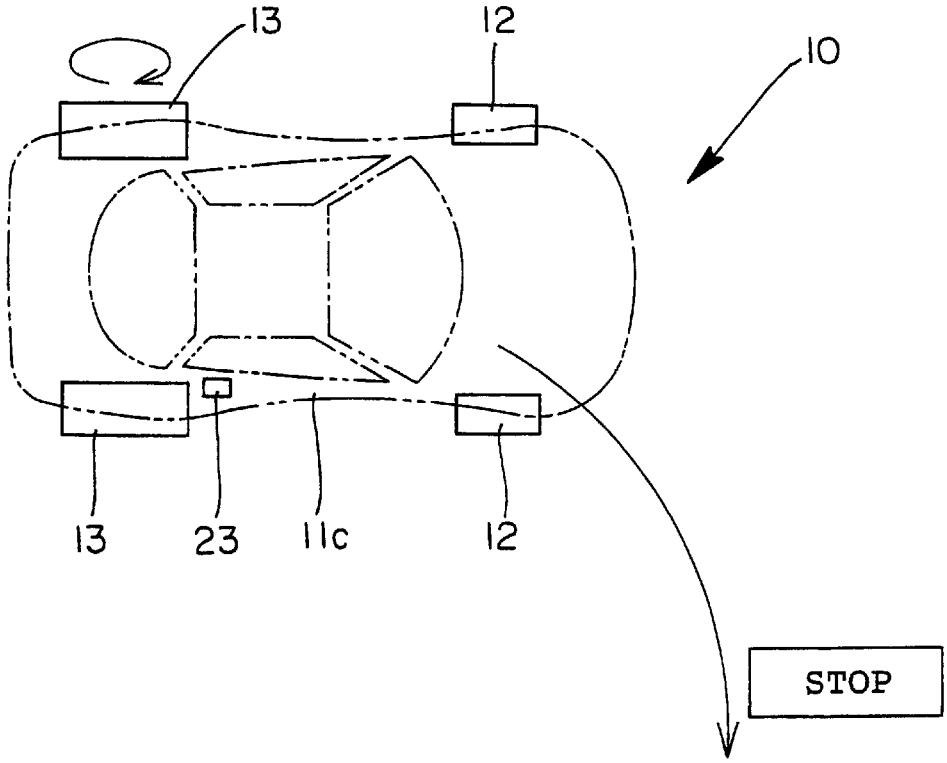
FIG. 3 is a plan view useful for explaining the state where the model car of the invention shifts from an advancing state to a spin-turn state.
Figure 4:
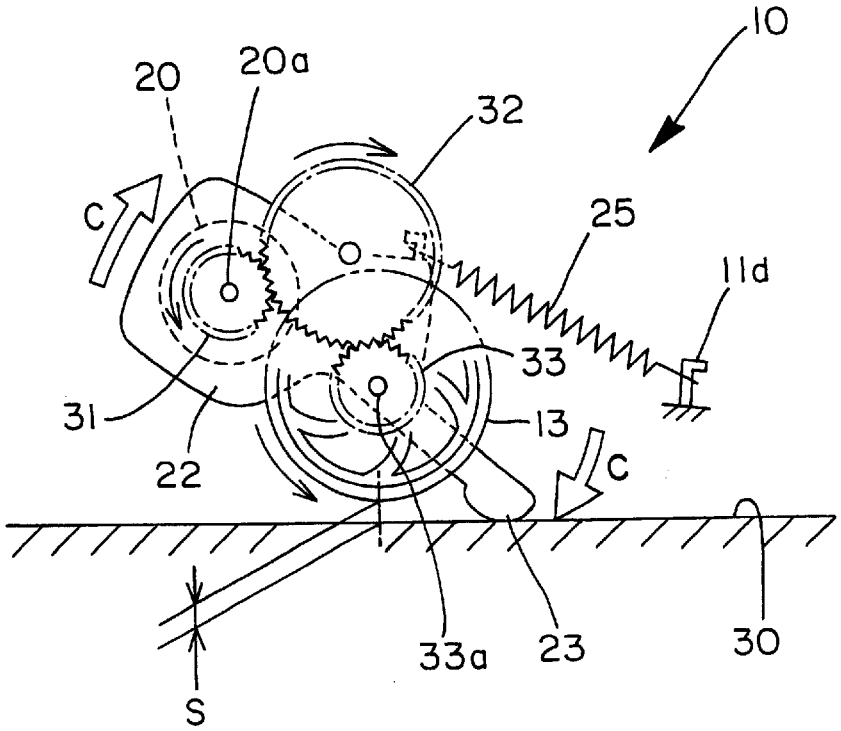
FIG. 4 is a mechanical view showing principal portions of the model car of the invention and useful for explaining the state where the model car is continuously pivoted and turned.
Figure 5:
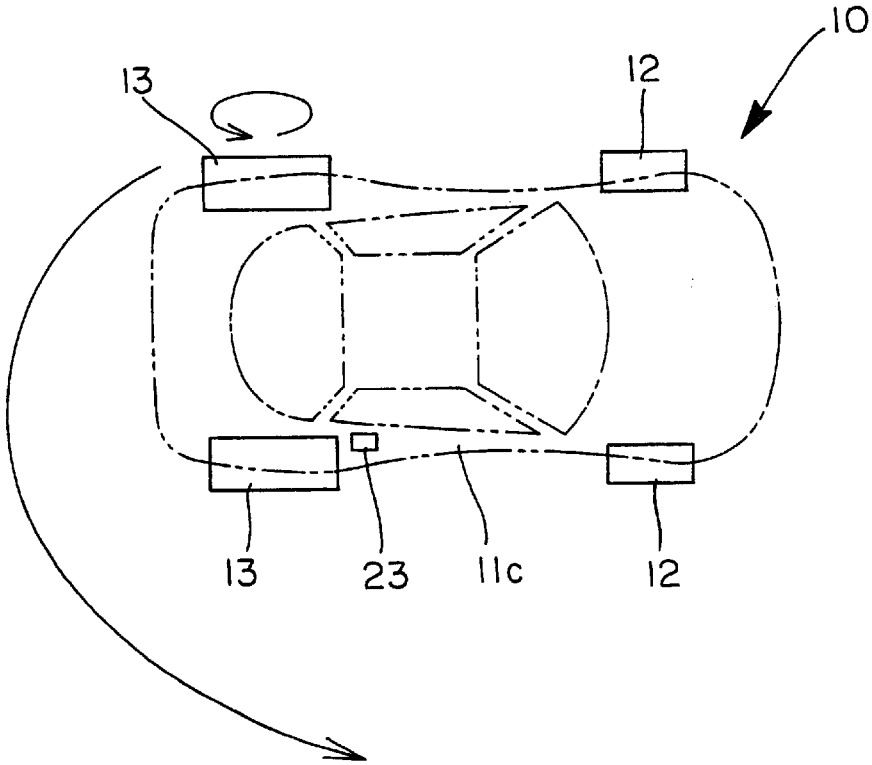
FIG. 5 is a plan view useful for explaining the state where the model car is pivoted and turned.

FIG. 1 is a side view showing a stop mechanism of a model car according to the invention. FIG. 2 is a mechanical view showing principal portions of the model car and useful for explaining the state where the model car shifts from an advancing state to a spin-turn state. FIG. 3 is its plan view. FIG. 4 is a mechanical view of the principal portions of the model car of the invention and useful for explaining the state where the model car is continuously pivoted and turned, and FIG. 5 is its plan view.

The model car 10 shown in FIG. 1 includes front wheels 12 rotatably fitted to a front part 11*a* of a car body 11 and driving rear wheels 13 rotatably fitted to a rear part 11*b* of the car body 11. A substrate 15 is interposed between the driving rear wheels 13 and the front wheels 12. A reception portion 16 is fitted to the substrate 15 and a transmission portion 17 transmits signals to the reception portion 16. The reception portion 16 outputs an operation signal to a driving motor 20. The operation signal rotates and drives the driving rear wheels 13 or stops rotation.

The transmission portion 17 has an advance button 17*a* and a back button 17*b*.

A seesaw-shaped swing member 22 is fitted to an axle 21 of the driving rear wheels 13 provided to the car body 11 of the model car 10 in such a fashion as to be capable swinging.

A driving motor 20 is mounted to the rear side 22*a* of the swing member 22 and a stopper plate 23 is provided to the front side 22*b* of the swing member 22.

The stopper plate 23 is arranged on the right side portion 11*c* of the car body 11 (see FIG. 3). A spring 25 for always biasing the swing member 22 in a direction in which the stopper plate 23 comes into touch with a road surface 30 is wound between the swing member 22 and the car body 11.

When the driving motor 20 is rotated in the advancing direction, reaction force is transmitted from the driving rear wheels 13 to the driving motor 20. An intermeshing gear is arranged in such a fashion this reaction force separates the stopper plate 23 from the road surface 30 against the biasing force of the spring 25.

In other words, the spring 25 is interposed between an engagement portion 11*d* of the car body 11 and an engagement portion 22*c* of the swing member 22 and biases clockwise the swing member 22 with the axle 21 as the axis of rotation in the presence of the spring 25. When no reaction force is transmitted from the driving rear wheels 13, the stopper plate 23 keeps touch with the road surface 30.

Here, a space S exists between an extension portion 11*e* extending rearward from the rear portion 11*b* of the car body 11 and the swing member 22.

Since the stopper plate 23 is arranged on the front side of the driving rear wheels 13, frictional resistance is allowed to efficiently act on the stopper plate 23 when the stopper plate 23 is brought into touch with the road surface 30.

Incidentally, a cell 14 is arranged on the car body 11 to drive the driving motor 20.

Next, explanation will be given with reference to FIGS. 1 to 3 on the case where the model car shifts from an advancing state to a spin-turn state.

First, when the advance button 17*a* of the transmitter 17 is pushed, the driving motor 20 is rotated for advance. In consequence, the drive shaft 20*a* of the driving motor 20 shown in FIG. 2 rotates for advance, and a drive gear 31 fitted to this drive shaft 20*a* rotates in a direction indicated by arrow (clockwise).

As the drive gear 31 rotates clockwise, an idle gear 32 rotates in a direction indicated by arrow (counter-clockwise). Rotation of the idle gear 32 is transmitted to a final gear 33 and the final gear 33 rotates in the direction of the arrow (clockwise).

As a result, a support shaft 33*a* (that also functions as the axle 21) interconnected to the final gear 33 rotates, and the driving rear wheels 13 rotate in the direction indicated by the arrow (clockwise).

When the driving motor 20 is driven for advance and the idle gear 32 is rotated through the drive gear 31 in this way, the reaction force develops from the idle gear 32 to the drive gear 31 and acts on the driving motor 20.

When the reaction force acts on the driving motor 20, the swing member 22 swings counter-clockwise (direction of the arrow A) with the support shaft 33*a* (axle 21) as the center of swinging against the biasing force.

Consequently, the stopper plate 23 is separated from the road surface 30 and rotation of the right and left driving rear wheels 13 is uniformly transmitted to the road surface 30. Eventually, the model car 10 is caused to drive straight in the direction of the arrow B.

Next, when the push force to the advance button 17*a* of the transmitter 17 is released, the driving motor 20 stops rotating. Since the reaction force acting on the driving motor 20 is released in this case, too, the biasing force of the spring 25 automatically swings clockwise the swing member 22 with the result that the stopper plate 23 comes into touch with the road surface 30 (condition shown in FIG. 1).

When the driving motor 20 stops rotating, inertia force acts on the mold car 10 as shown in FIG. 3, and the model car 10 is to decelerate and stop while keeping its straight advancing state. Since the stopper plate 23 keeps touch with the road surface 30 at this time, however, the stopper plate 23 functions as the frictional resistance so that the right side portion 11*c* of the car body 11 comes to a sudden stop but the left side portion of the car body does not. Therefore, the car body 11 stops under the spin-turn state to the right.

In this way, the model car shifts to the spin-turn state from the straight advancing state.

Next, the state where the model car is continuously pivoted and turned will be explained with reference to FIGS. 1, 4 and 5.

When the back button 17*b* of the transmitter 17 shown in FIG. 1 is pushed and the driving motor 20 is rotated for advance, the drive shaft 20*a* of the driving motor 20 shown in FIG. 4 rotates for backward movement and the drive gear 31 fitted to the drive shaft 20*a* rotates in the direction of the arrow (counter-clockwise).

As the drive gear 31 rotates counter-clockwise, the idle gear 32 rotates in the direction of the arrow (clockwise) and rotation of the idle gear 32 is transmitted to the final gear 33. The final gear 33 thus rotates in the direction of the arrow (counter-clockwise).

Consequently, the support shaft 33*a* (axle 21) to which the final gear 33 is interconnected rotates and the driving rear wheels 13 rotate in the direction of the arrow (counter-clockwise).

When the driving motor 20 is rotated for backward movement to rotate the idle gear 32 through the drive gear 31, the reaction force develops from the idle gear 32 to the drive gear 33 and acts on the driving motor 20.

As the reaction force acts on the driving motor 20, the swing member 22 swings clockwise (in the direction of the arrow C) with the axle 21 as the center, and pushes the stopper plate 23 to the road surface 30.

Here, the space S exists between the extension portion 11*e* extending rearward from the rear portion 11*b* of the car body 11 and the swing member 22 as shown in FIG. 1.

Since the space S is secured between the extension portion 11*e* of the car body 11 and the swing member 22, the swing member 22 swings clockwise from the state shown in FIG. 1 with the axle 21 as the center and can float the driving rear wheels 13 in the side of the stopper plate 23 by a distance corresponding to the space S from the road surface 30 when the driving motor 20 is rotated for back movement.

Consequently, when the driving motor 20 is rotated for back movement, the model car 10 can be continuously pivoted and rotated with the stopper plate 23 as the center of turning as shown in FIG. 5.

In the embodiment explained above, the stopper plate 23 is arranged on the right side 11*c* of the car body 11. However, the stopper plate 23 may be arranged on the left side of the car body 11.

As described above, in the model car according to claim 1, the seesaw-shaped swing member is mounted to the car body in such a fashion as to be capable of swinging, the driving motor is fitted to the rear side of this swing member and the stopper plate is provided to the front side of the swing member. Therefore, the operator can stop the model car while the car body is under the spin-turn state, by merely releasing the push force of the advance button of the transmitter. Since the stopper plate may well be shaped into the form of the seesaw-shaped swing member, it brings about effects such that the overall construction can be simplified.

The invention according to claim 2 pushes the stopper plate to the road surface by using the reaction force occurring when the backward turning force of the driving motor is transmitted to the rear wheels to float the rear wheels on the stopper plate side from the road surface. Therefore, continuous pivot turning becomes possible with the stopper plate as the center of turning, and the model car can be maneuvered more enjoyably.

What is claimed is:

1. A stop mechanism of a model car for use in a model car of a type wherein driving force of a driving motor is transmitted to driving rear wheels through an intermeshing gear for running said model car, comprising:

a seesaw-shaped swing member mounted at a position of a car body deviated either to the right or left from a center line of said model car in a driving direction, and supported by an axle of said driving rear wheels in such a fashion as to be capable of swinging;

a driving motor fitted to a rear side of said swing member;

a stopper plate fitted to a front side of said swing member;

a spring for always biasing said swing member in a direction in which said stopper plate of said swing member comes into contact with a road surface, interposed between said swing member and said car body; and an intermeshing gear arranged in such a fashion that when said driving motor is rotated for advance, a direction of reaction force transmitted from said driving rear wheels to said driving motor operates in a direction in which said stopper plate is separated from the road surface against the biasing force of said spring.

2. A stop mechanism of a model car according to claim 1, wherein said intermeshing gear is arranged in such a fashion that when said driving motor is rotated for backward movement, the direction of reaction force transmitted from said driving rear wheels to said driving motor is the same as a direction in which said stopper plate comes into touch with the road surface.

* * * * *